US005206057A

United States Patent [19]

Finnicum et al.

[11] Patent Number: 5,206,057

[45] Date of Patent: Apr. 27, 1993

[54] METHOD AND APPARATUS FOR ADJUSTING THE CURTAIN IMPINGEMENT LINE IN A CURTAIN COATING APPARATUS

[75] Inventors: Douglas S. Finnicum, Webster; Kenneth J. Ruschak, Rochester; Steven J. Weinstein, Fairport, all of N.Y.

[73] Assignee: Eastman Kodak Company, Rochester, N.Y.

[21] Appl. No.: 819,536

[22] Filed: Jan. 10, 1992

[51] Int. Cl.[5] ..... B05D 1/30

[52] U.S. Cl. ..... 427/420; 118/300; 118/DIG. 4

[58] Field of Search ..... 427/420; 118/DIG. 4, 118/300

[56] References Cited

U.S. PATENT DOCUMENTS

| | | | |
|---|---|---|---|
| 2,681,294 | 6/1954 | Beguin | 118/DIG. 4 |
| 2,761,419 | 9/1956 | Mercier et al. | 118/412 |
| 2,761,791 | 9/1956 | Russell . | |
| 3,508,947 | 4/1970 | Hughes | 427/420 |
| 3,632,374 | 1/1972 | Greiler | 118/324 |
| 4,019,906 | 4/1977 | Ridley | 427/420 |
| 4,128,667 | 12/1978 | Timson | 427/348 |
| 4,135,477 | 1/1979 | Ridley | 118/325 |
| 4,170,958 | 10/1979 | Moser | 118/325 |
| 4,202,188 | 5/1980 | Grüber | 118/325 |
| 4,230,743 | 10/1980 | Nakamura et al. | 427/146 |
| 4,287,240 | 9/1981 | O'Connor | 427/402 |
| 4,716,058 | 12/1987 | Morin | 427/420 |
| 4,830,887 | 5/1989 | Reiter | 427/420 |
| 4,842,900 | 6/1989 | Miyamoto | 427/348 |
| 5,114,759 | 5/1992 | Finnicum et al. | 427/420 |

*Primary Examiner*—Shrive Beck
*Assistant Examiner*—Katherine A. Bareford
*Attorney, Agent, or Firm*—William T. French; Carl F. Ruoff; Joshua G. Levitt

[57] ABSTRACT

In a curtain coating apparatus for the coating of photographic film and paper webs and the like, the line of impingement of the curtain on the moving web is controlled by providing a pressure controlled zone on one side of the flowing curtain. Small changes in the static air pressure in the zone cause the position of the curtain to move without disturbing the quality of the curtain. Wetted side walls of the pressure controlled zone can serve as edge guides for the curtain.

17 Claims, 4 Drawing Sheets

METHOD AND APPARATUS FOR ADJUSTING THE CURTAIN IMPINGEMENT LINE IN A CURTAIN COATING APPARATUS

FIELD OF THE INVENTION

This invention relates to a curtain coating apparatus and method and, more particularly, to such an apparatus and method, wherein the position of the line of impingement of the curtain coating liquid on a moving substrate is controlled.

BACKGROUND OF THE INVENTION

One method for continuously coating thin layers of a liquid composition on a moving substrate such as a continuous web is the so-called curtain coating method. An early description of a curtain-coating method and apparatus for use in the manufacture of photographic film and paper is found in the patent to Hughes, U.S. Pat. No. 508,947, incorporated herein by reference. This and subsequent patents relating to curtain coating (e.g., U.S. Pat. No. 3,632,374 and U.S. Pat. No. 4,287,240) describe the use of a coating hopper to form a free-falling curtain of liquid photographic coating composition which impinges transversely across a moving web of film or paper and forms a coated layer thereon.

As the earlier patents indicate, curtain coating has capabilities which make it preferable to other coating methods for many products. Thus, although bead coating, as disclosed, for example, in the patent to Beguin, U.S. Pat. No. 2,681,294, the patent to Mercier et al., U.S. Pat. No. 2,761,419, the patent to Russell, U.S. Pat. No. 2,761,791 and others, is a valuable process, higher coating speeds are attainable in curtain coating. Also certain coating defects are more readily avoided in curtain coating, as explained in U.S. Pat. No. 3,632,374, cited above.

Despite its important advantages, curtain coating, presents the problem that the falling curtain can be disturbed by ambient air currents with resulting defects in the coated product. A solution to this problem is offered in the patent to O'Connor, U.S. Pat. No. 4,287,240. The patent describes forming a shield of a foraminous material such as screening or a perforated plate around the coating apparatus. The foraminous shield diffuses air currents to reduce their velocity and protect the curtain. Another solution is offered in the co-pending U.S. Pat. No. 5,114,759, issued to Finicum et al., filed Jul. 12, 1991, incorporated herein by reference.

Still another characteristic of curtain coating that can be a problem is that the curtain tends to bend back as it falls from the hopper or die. This is the so-called "teapot" or Coanda effect, which is discussed in the patent to Ridley, U.S. Pat. No. 4,135,477. Because of the bend-back characteristic, if it is desired to have the curtain impinge at top-dead-center of the coating roll over which the web passes, as in FIGS. 4 and 6 of the patent to Greiler, U.S. Pat. No. 3,632,374, the hopper lip must be positioned somewhat forward of that position. However, the correct position for one set of coating conditions, e.g., flow rates and viscosities, may not be suitable for other conditions. This can require movement of the hopper to move the line of impingement, which is often difficult. Furthermore, even when coating conditions are such that the same bend back will occur, it may be desirable to change the line of impingement from top-dead-center to another position without having to move the hopper.

A further problem in curtain coating is the tendency of the curtain to contract laterally under the influence of surface tension as it falls from the coating hopper. This is discussed, for example, in the patent to Reiter, U.S. Pat. No. 4,830,887, incorporated herein by reference, which describes the use of edge guides to prevent contraction of the width of the falling curtain. Edge guides fix the positions of the edges of the curtain. However, the teapot effect will control the position of the curtain between the edges. Typically, when vertical edge guides are used, the line of impingement of the curtain is curved rather than a straight line, with the center of the curtain impinging on the substrate at a point substantially to the rear of the edges. This can cause uneven thickness of the coating and other undesired results. A need exists, therefore, for a curtain coating method and apparatus in which the line of impingement of the curtain on the moving substrate can be maintained as a straight line or can easily be moved backward or forward as desired.

BRIEF SUMMARY OF THE INVENTION

This desirable result is accomplished by the apparatus of the invention which includes a means for continuously moving a substrate along a path through a coating zone, from an upstream direction to a downstream direction.

Positioned above said path is a hopper means for forming a continuously flowing, liquid curtain in the coating zone, the curtain having an upstream and a downstream side and impinging on the moving web in a line transversely across the substrate to form a coated layer of said liquid thereon.

An enclosure means within the apparatus includes (a) a pair of planar side walls positioned on opposite sides of the substrate parallel to the direction of movement thereof, said walls extending vertically from said hopper to the substrate and (b) a lateral wall connecting the side walls and extending vertically to a position close to the substrate.

The enclosure means, in combination with the hopper means, the substrate and the curtain, forms a pressure controlled zone in which a substantially static gas pressure can be maintained. In addition, the apparatus includes means for controlling the static gas pressure in said zone and for establishing a pressure differential between the upstream and downstream sides of the curtain.

The curtain coating method of the invention comprises continuously moving a substrate along a path through a coating zone, forming a continuously flowing, liquid curtain in said coating zone above the path of said substrate, impinging the flowing liquid curtain on the moving substrate in a line transversely across the substrate to form a coated layer of said liquid thereon, maintaining a static gas pressure on both sides of said curtain, and creating a gas pressure differential between the upstream and downstream sides of said curtain to move the line of impingement of the curtain on the substrate without disturbing the uniform flow of said curtain.

THE DRAWINGS

The invention will be described in detail by reference to the drawings of which:

DETAILED DESCRIPTION

Figure 1:
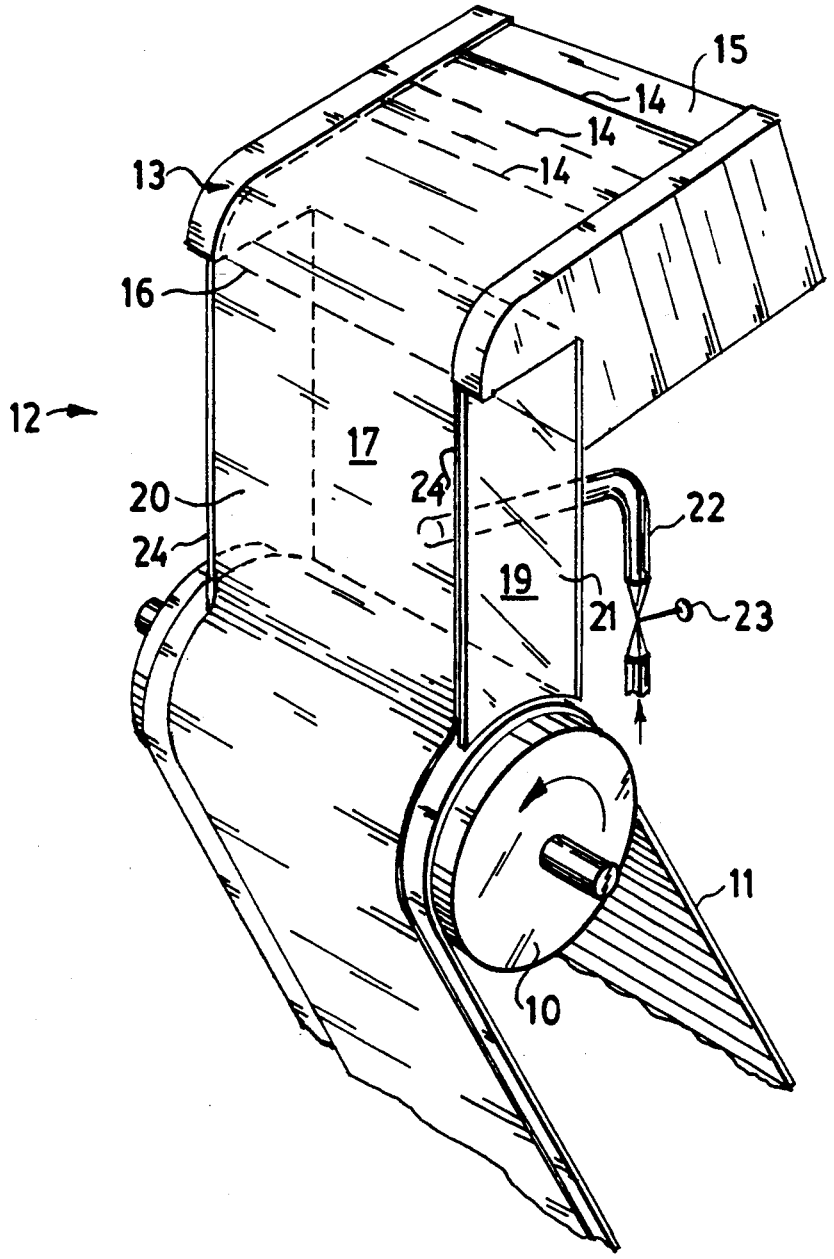
FIG. 1 is a perspective view of an apparatus of the invention.

In FIG. 1 a roll 10 serves to move a substrate 11, which can be, for example, a continuous web 11 of photographic film support or paper, through a coating zone, generally designated as 12, below a curtain coating hopper 13. The latter is provided with a plurality of slots 14 through which liquid coating compositions such as photographic gelatin-silver halide emulsions flow. The liquid compositions from the slots form a multilayer stream which moves in laminar flow down the slide 15 of hopper 13 and falls freely from the lip 16 of hopper 13 as a continuously flowing liquid curtain 17.

Figure 2:
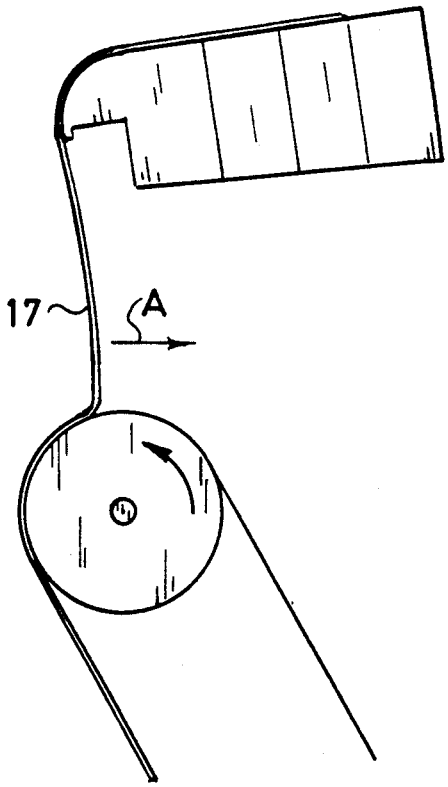
FIG. 2 is a schematic side view of a coating apparatus, illustrating the teapot effect in curtain coating.

Although FIG. 1 shows a planar vertical curtain, between edge guides 24, FIG. 2 shows that if allowed to fall freely, the curtain 17 bends backwardly in the upstream direction, i.e., in the direction indicated by arrow A. The opposite direction is called the downstream direction. As previously mentioned, this bend-back tendency is called the Coanda or teapot effect. In the apparatus of the invention the bend back of the curtain can be restrained.

As shown in FIG. 1, the apparatus of the invention includes an enclosure means which comprises a pair of planar side walls 19 and 20 on opposite sides of web 11. The side walls are positioned parallel to the direction of movement of the web. Each wall extends downwardly from the hopper to the web or, more precisely, to a position in close proximity to the web. Ideally, the side walls are as close as possible to the web without impeding its movement so that there is a minimum of space between the web and the walls. As will be explained more fully, the leakage of air from the enclosure means is thereby minimized.

The enclosure means also includes on its upstream side a lateral rear wall 21. The lateral wall connects the sidewalls and, like the side walls, extends vertically from the hopper 13 to the web 11, i.e., to a position very close to the web. Although shown as a planar wall in FIG. 1 the lateral wall can be curved. Its function as a member of the enclosure means is to form a pressure controlled zone with the side walls, the hopper, the web and the curtain, within which a substantially static gas pressure, e.g., air pressure, can be maintained and controlled.

FIG. 1 shows a valved conduit 22 mounted in the lateral wall 21. This line, by control of valve 23, can admit or withdraw air or other gas e.g., an inert gas such as nitrogen, into or from the pressure controlled zone to control the static gas pressure therein.

Figure 3:
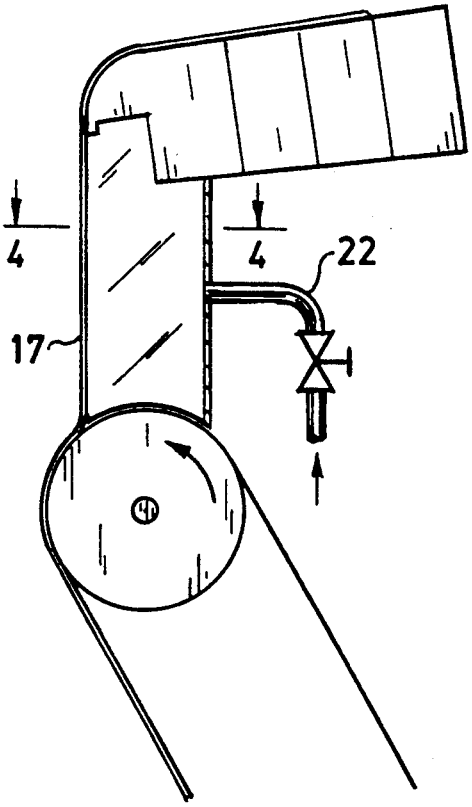
FIG. 3 is a schematic side view of an apparatus of the invention.

In the embodiment of FIGS. 1 and 3, when air is admitted to the pressure controlled zone by conduit 22 from a higher pressure source, the pressure on the upstream side of curtain 17 exceeds the pressure on the downstream side. As a consequence of this pressure differential the line of impact of curtain 17 on the web 11 moves, for example, from top-dead-center to a line forward thereof as in FIGS. 1 and 3. Likewise the curtain can be drawn backwardly to impinge on a line rearward of top-dead-center by withdrawing air from the chamber via line 22 when the latter connects with a low pressure source.

This movement of the curtain in accordance with the invention is accomplished by small and gradual changes in the air pressure on one side of the curtain in the pressure controlled zone which is formed by the enclosure means and the curtain 17. In this way a stable uniform curtain is maintained and the formation of unsatisfactory coated product is minimized.

It should be understood that the gas pressure within the pressure controlled zone is substantially static. Although some minor leakage of air occurs because there is not a perfect seal between the walls and the web, the leakage is kept low by positioning the walls as close to the web as possible without impeding movement. In this way a substantially static gas pressure is maintained within the pressure controlled zone formed by the enclosure means and the curtain 17. By "substantially static gas pressure" is meant that no more than a negligible or very low gas flow rate occurs in the pressure controlled zone. More specifically, the gas flow rate (e.g., air flow rate) which maintains a substantially static air pressure in the zone is sufficiently low that the velocity of the gas within one centimeter of the curtain is less than about 4 meters per minute. Such a low flow rate avoids injury to the curtain. See U.S. Pat. No. 5,114,759, cited above.

This maintenance of a substantially static air pressure in the vicinity of the curtain is in marked contrast to the conditions disclosed in the patent to Timson, U.S. Pat. No. 4,128,667. The latter patent discloses an apparatus for guiding a coating composition stream emitted from a coating applicator onto a moving web. Aerodynamic forces from an air foil effect are used to flip a stream back and forth rapidly by increasing or decreasing the relative air velocities on the two sides of the stream. This control of rapidly moving air flows is markedly different from the procedure of the present invention wherein changes in the substantially static pressure of an atmosphere in contact with a falling liquid curtain are used to position the impingement line of the curtain without changing the velocity of flow of the curtain and without disrupting its laminar flow.

The capability of maintaining a substantially static air pressure in the vicinity of the liquid curtain of coating liquid distinguishes the apparatus and method of the present invention from the apparatus of U.S. Pat. No. 4,287,240 which surrounds the curtain with a foraminous screen. Such a screen, of course, cannot maintain a zone of static air pressure.

As indicated in the drawings, the side and lateral walls of the enclosure means can be transparent. Suitable materials include plastic sheeting such as poly(-methyl methacrylate) sheeting, glass plates and opaque materials such as stainless steel plates. Advantageously, the side walls are formed of or coated with a material that is readily wettable by the curtain liquid, in the event that the side walls are to serve as edge guides for the curtain.

Figure 7:
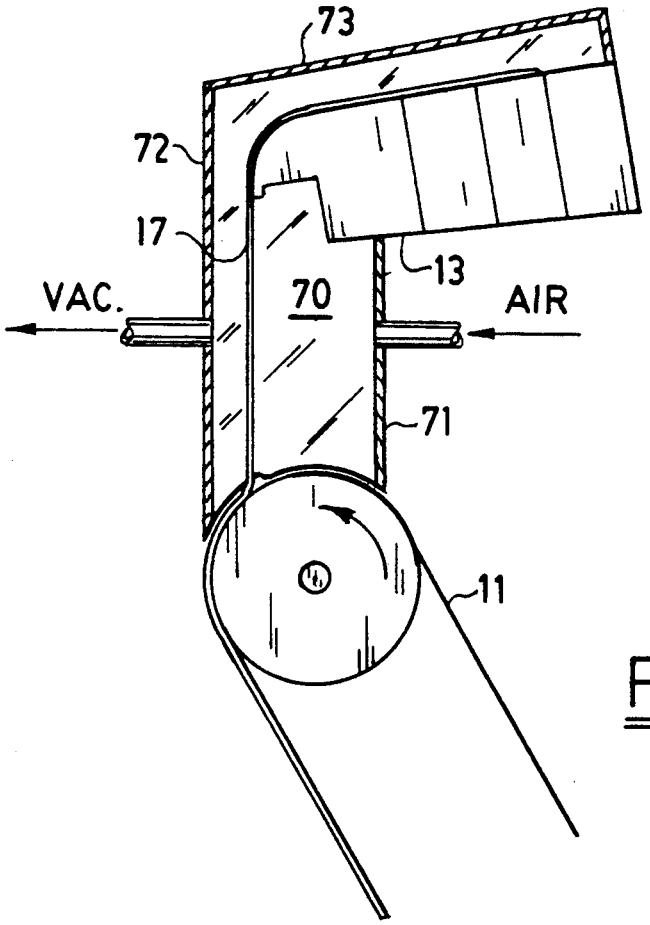
FIG. 7 is a schematic side view of still another embodiment of an apparatus of the invention.

As described above, the control of the position of the falling curtain can be achieved by an enclosure means which has two solid side walls and a solid lateral wall, the curtain itself forming a fourth wall of the pressure controlled zone. FIG. 7 shows another embodiment of the apparatus of the invention in which the enclosure means includes a fourth solid wall on the downstream side of the curtain. In the embodiment of FIG. 7, the enclosure means includes a pair of side walls, e.g., wall 70, an upstream lateral wall 71 extending from hopper 13 to a position close to web 11 and a downstream lateral wall 72 which, with its extension 73, extends from close to web 11 to a line of contact 74 with hopper 13. The vertical side walls, e.g., 70, in this embodiment extend vertically from extension 73 to a position in close proximity to web 11 and horizontally from wall 71 to wall 72. As in the embodiment of FIG. 1, the edges of the curtain are in contact with edge rods or with the side walls which serve as planar edge guides. In either case, the curtain forms one side of a pressure controlled zone. In the embodiment of FIG. 7, there are two such zones, one on the upstream side and one on the downstream side of curtain 17. An enclosure means as in FIG. 7 which encloses both sides of the curtain is advantageous when there is a risk of fluctuations in the ambient pressure of the coating zone.

FIG. 7 demonstrates that a pressure control zone can be on the downstream side of the curtain 17. Provided that the ambient atmospheric pressure is reasonably constant, only one pressure control zone is needed. It can be on the upstream side of the curtain as in FIG. 1 or on the downstream side as in FIG. 7.

Figure 4:
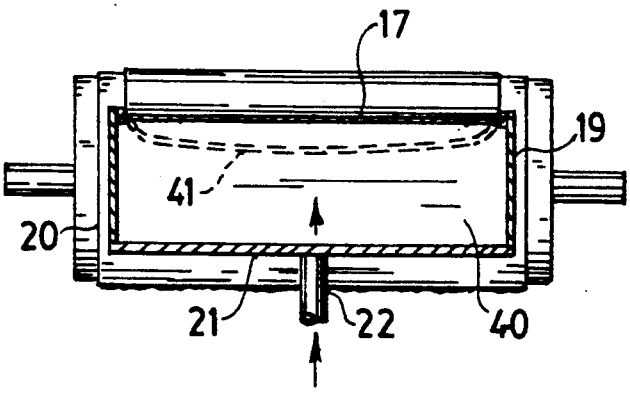
FIG. 4 is a schematic view along line 4—4 of FIG. 3.

In the embodiments of FIGS. 1 and 7 the edges of the curtain can be in contact either with edge rods such as rods 24 of FIG. 1 or can be in direct contact with the respective side walls of the enclosure means which serve as planar edge guides. When edge rods are employed, a rod extends from each side of the hopper to a position close to the substrate or web 11. Surface tension holds the edge of the curtain in contact with the guide rods. As previously mentioned, when the curtain edges are in contact with edge rods, the center of the curtain can bow in either the upstream or downstream direction depending on the control of the pressure differential on the opposite faces of the curtain. This is illustrated by FIG. 4 which shows the pressure controlled zone 40 along line 4—4 of FIG. 3. In this figure the zone is bounded by side walls 19 and 20, the upstream lateral wall 21 and the curtain 17. A gentle air flow through the conduit 22 controls the substantially static pressure in the zone. FIG. 4 shows in dotted lines 41 the position of the curtain when the zone 40 is left open to the atmosphere and no effort is made to control the pressure in the zone. In this event the teapot effect causes the middle of the curtain to bow in the upstream direction as indicated by the dotted line 41. When a slightly elevated pressure is created in the zone by introducing air by conduit 22, the curtain is moved to the straight line position 17.

Whether the curtain edges are in contact with edge rods or with the planar surfaces of the side walls, it is advantageous to wet and/or heat at least temporarily, those rod or wall surfaces that are in contact with the edges of the curtain. It is especially desirable when the curtain is in contact with the planar side walls to wet the walls with a heated liquid at start-up and when changing the pressure in the pressure controlled zone to cause the position of the curtain to move. The liquid should be compatible with, i.e., miscible with, the liquid curtain. When the coating composition is an aqueous photographic gelatin silver halide emulsion, the preferred liquid is water or water containing a surfactant to improve the wetting of the side walls.

Figure 5:
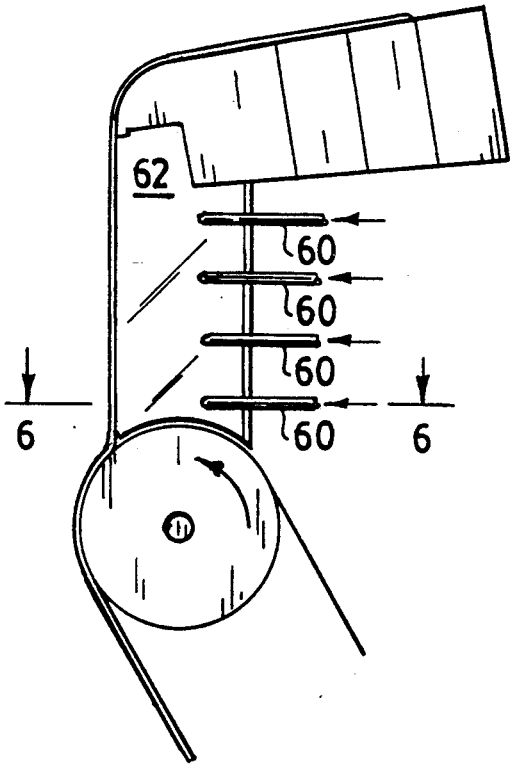
FIG. 5 is a schematic side view of another embodiment of an apparatus of the invention.
Figure 6:
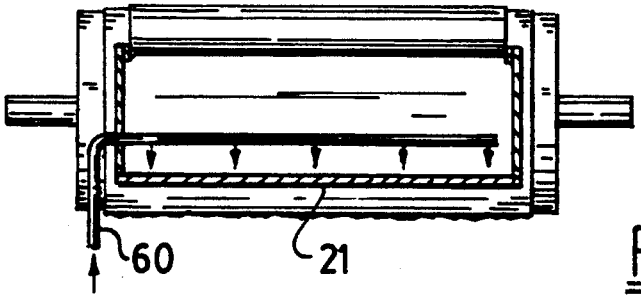
FIG. 6 is a schematic view along line 6—6 of FIG. 5.

Although FIGS. 1, 3, 4 and 7, for simplicity of illustration, show a single conduit 22 for introducing or withdrawing air or other gas from the pressure controlled zone, it is preferred to introduce or withdraw the gas from a plurality of points in order to minimize the risk of an air current that would disturb the curtain. FIGS. 5 and 6 show a desirable arrangement wherein the pressure is controlled by air introduced through lines 60, each of which is controlled by valves not shown in the drawing. Especially suitable is the structure shown in FIG. 6 wherein lines 60 are in the form of a manifold which releases a gentle stream of air across the rear wall 21 of the enclosure means at several points. This means for controlling pressure within the enclosure means causes the least possible disturbance of the curtain.

Heating of the side walls or of all interior surfaces of the pressure controlled zone is also desirable for avoiding condensation of vapor in the pressure controlled zone. Heating can be accomplished in a number of different ways. For example, a heated liquid can be flowed downwardly on the side walls or hot water can be flowed on the outside of the walls. The air introduced in the pressure controlled zone can also be heated. Another possibility is to use a heating means such as electrical resistance heating wires in the wall or the walls can be formed of a conductive material which can be warmed by electrical resistance heating.

The temperature to which the walls are heated can be varied in accordance with the nature of the composition being coated. For a photographic gelatin composition, for example, the walls in contact with the curtain edges should be kept at a temperature above the melting temperature of the gelatin so that the gelatin does not solidify on the walls. With a typical gelatin emulsion coating temperature of about 105° F., advantageously, water is flowed down the walls at the same temperature to prevent solidifying of the gelatin.

In tests that applicants have carried out, a liquid curtain was surrounded on all four sides by an air-tight enclosure made of "Plexiglas" acrylic polymer sheeting. A liquid curtain was formed by flowing through a die slot a solution of 0.5 weight percent "Natrosol" surfactant in water at 40° C., the solution having a viscosity of 15 cps and a density of 1.03 g/cc. The surfactant concentration was such that the dynamic surface tension in the curtain was equal to the static surface tension value of 31.2 dynes/cm. The solution was evenly distributed across the width of the curtain by the use of a die having a large internal cavity and a narrow exit slot. Specifically, dies having exit slot heights of 0.025 cm and 0.05 cm were used. A curtain 20.3 cm wide and 30.5 cm high was formed in each test. Since the position of the curtain deviated from vertical substantially in the tests, the side walls of the enclosure were used as the support for the curtain, i.e., as the edge guides, instead of edge rods or wires.

With the test apparatus described pressure differentials were created between the upstream and downstream sides of the curtain. Extremely small pressure differentials, i.e., less than 10 dynes/cm$^2$ were sufficient to move the curtain. Although the tests were not coating runs since the curtain did not impinge on a moving substrate, they demonstrated successful control of the line of impingement of the curtain by controlling the static pressure differential on the opposite faces of the curtain.

The invention has been described in detail with particular reference to preferred embodiments thereof, but it will be understood that variations and modifications can be effected within the spirit and scope of the invention.

We claim:

1. A curtain coating apparatus comprising means for continuously moving a substrate along a path through a coating zone, from an upstream direction to a downstream direction, a hopper means positioned above said path for forming a continuously flowing, curtain of liquid in said coating zone, said curtain having an upstream and a downstream side and impinging on the moving substrate in a line transversely across the substrate to form a coated layer of said liquid thereon, an enclosure means which includes (a) a pair of planar side walls positioned on opposite sides of the substrate parallel to the direction of movement thereof, said walls extending vertically from said hopper means to said substrate and (b) an upstream wall extending from the hopper means to a position close to said substrate, said enclosure means, in combination with the hopper means, the substrate and the curtain, forming a pressure controlled zone in which a substantially static gas pressure can be maintained, and means for controlling the static gas pressure in said zone and for establishing a pressure differential between the upstream and downstream sides of the curtain.

2. An apparatus according to claim 1 wherein a valved conduit mounted in a wall of said enclosure means is adapted to introduce or withdraw air to change the pressure within the pressure controlled zone on one side of said curtain.

3. An apparatus according to claim 1 wherein the spaces between said walls and the substrate and between the walls and the hopper are so small that when a super-atmospheric or subatmospheric pressure is maintained in the pressure controlled zone the flow rate of air through said spaces is so small that a substantially static atmosphere can be maintained within said zone and no substantial fluctuation in the curtain position occurs.

4. An apparatus according to claim 1 wherein the surfaces of said side walls are wettable by said liquid.

5. An apparatus according to claim 1 which further includes means for heating said walls.

6. An apparatus according to claim 1 wherein said enclosure means includes a downstream lateral wall for maintaining a pressure controlled zone on the downstream side of said curtain.

7. An apparatus according to claim 1 which also includes a guide rod extending downwardly from each side of said hopper to a position close to said substrate.

8. An apparatus according to claim 1, whereby the pressure in said zone may be manipulated to move the line of impingement of the curtain on the substrate without disturbing the uniform flow of said curtain.

9. A curtain coating method which comprises continuously moving a substrate along a path through a coating zone, forming a continuously flowing, curtain of liquid in said coating zone above the path of said substrate, impinging the flowing liquid curtain on the moving substrate in a line transversely across the substrate to form a coated layer of said liquid thereon, maintaining a static gas pressure on both sides of said curtain, and creating a gas pressure differential between the upstream and downstream sides of said curtain to move the line of impingement of the curtain on the substrate without disturbing the uniform flow of said curtain.

10. A method according to claim 9 wherein said substrate is a photographic film support web or a paper web and said liquid is a photographic composition.

11. A method according to claim 10 wherein said curtain comprises a plurality of layers of photographic compositions moving together in laminar flow.

12. A method according to claim 9 wherein the gas pressure is air pressure.

13. A method according to claim 9 wherein said static gas pressure is maintained within a pressure controlled zone which is enclosed in part by said curtain and wherein the pressure on one side of said curtain within said zone is varied to change the line of impingement of the curtain on the substrate.

14. A method according to claim 9 wherein said static gas pressure is maintained on one side of said curtain within a pressure controlled zone formed in part by side walls and by said curtain, the edges of which are maintained in contact with said side walls.

15. A method according to claim 14 wherein said walls are heated to prevent condensation of liquid within said pressure controlled zone.

16. A method according to claim 14 wherein said side walls are wettable by said liquid curtain.

17. A method according to claim 14 wherein said side walls are wetted and heated by flowing along said walls a heated liquid which is compatible with the liquid curtain.

* * * * *